US009286837B2

(12) United States Patent
Cho et al.

(10) Patent No.: US 9,286,837 B2
(45) Date of Patent: Mar. 15, 2016

(54) DISPLAY DEVICE AND DRIVING METHOD THEREOF

(71) Applicant: Samsung Display Co., Ltd., Yongin (KR)

(72) Inventors: Jae Hyun Cho, Seoul (KR); Jae Byung Park, Seoul (KR); Se Young Song, Hwaseong-si (KR); Seon-Tae Yoon, Seoul (KR); Hyun Min Cho, Seoul (KR); Sung-Jin Hong, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 41 days.

(21) Appl. No.: 14/337,862

(22) Filed: Jul. 22, 2014

(65) Prior Publication Data

US 2015/0221260 A1 Aug. 6, 2015

(30) Foreign Application Priority Data

Feb. 6, 2014 (KR) ..... 10-2014-0013725

(51) Int. Cl.

| | |
|---|---|
| ***G09G 3/36*** | (2006.01) |
| ***G09G 3/34*** | (2006.01) |
| ***G09G 3/20*** | (2006.01) |

(52) U.S. Cl.

CPC ..... *G09G 3/3413* (2013.01); *G09G 3/2003* (2013.01); *G09G 2310/0232* (2013.01); *G09G 2310/0235* (2013.01); *G09G 2320/0228* (2013.01); *G09G 2320/0242* (2013.01)

(58) Field of Classification Search

CPC ..... G09G 2300/0439–2300/0465; G09G 2300/088–2300/0895; G09G 3/2074; G09G 3/2983–3/2986; G09G 3/364; G09G 3/3648–3/3666; G09G 2310/021

See application file for complete search history.

(56) References Cited

U.S. PATENT DOCUMENTS

| | | | |
|---|---|---|---|
| 6,567,097 | B1 | 5/2003 | Iwaki |
| 8,305,388 | B2 | 11/2012 | Park et al. |

FOREIGN PATENT DOCUMENTS

| | | |
|---|---|---|
| JP | 2010-170141 | 8/2010 |
| JP | 2011-009169 | 1/2011 |
| JP | 2012-084814 | 4/2012 |
| KR | 1020070116512 | 12/2007 |
| KR | 1020130007309 | 1/2013 |

*Primary Examiner* — Sanghyuk Park

(74) *Attorney, Agent, or Firm* — H.C. Park & Associates, PLC

(57) ABSTRACT

A display device includes: a display panel configured with rows of pixels, each row pixels including a first color pixel, a second color pixel, and a third color pixel; and a backlight assembly configured to supply light to the display panel, in which: a data signal is alternately applied to a first color pixel disposed in an odd row on an odd frame, and to another first color pixel disposed in an even row on an even frame, a data signal is alternately applied to a second color pixel disposed in the odd row on the odd frame, and to another second color pixel disposed in the even row on the even frame, a data signal is applied to a third color pixel on both frames, and colors of light supplied to the display panel on the odd frame and the even frame are different from each other.

20 Claims, 8 Drawing Sheets

DISPLAY DEVICE AND DRIVING METHOD THEREOF

CROSS-REFERENCE TO RELATED APPLICATION

This application claims priority from and the benefit under 35 U.S.C. §119(a) of Korean Patent Application No. 10-2014-0013725, filed on Feb. 6, 2014, the entire disclosure of which is incorporated herein by reference for all purposes.

BACKGROUND

1. Field

The present disclosure relates to a display device and a driving method thereof. More particularly, to a display device configured to acquire a margin to perform sufficient charging, and a driving method thereof.

2. Discussion of the Background

A flat panel display is classified as a non-emissive display device, such as a liquid crystal display (LCD), or a self-light emitting display device, such as a field emission display (FED), an organic light emitting display (OLED), and a plasma display panel (PDP).

In general, an active matrix type of flat panel display includes a plurality of pixels arranged in a matrix, and displays an image by controlling the light strength of each pixel according to given luminance information. A liquid crystal display, among the flat panel displays, includes two display panels having pixel electrodes and a common electrode, and a liquid crystal layer interposed between the two display panels and having dielectric anisotropy. In order to display an image, the liquid crystal display applies electric fields to a liquid crystal layer and controls the transmittance of light passing through the liquid crystal layer by controlling the strength of the electric field.

Regarding the liquid crystal display, each pixel displays one of red, green, and blue (i.e., a spatial division color expression scheme) or all the pixels change colors and express the same with respect to time (i.e., a temporal division color expression scheme) to realize displaying of colors.

The spatial division color expression scheme installs red, green, and blue filters in a region that corresponds to a pixel electrode and expresses colors. In this case, the scheme can allow light provided by a white light source to pass through the liquid crystal layer and the color filter to display the corresponding color.

The temporal division color expression scheme installs red, green, and blue light sources individually to realize the colors of the liquid crystal display.

The temporal division color expression scheme scans all pixels according to operations by a gate driver and a data driver, turns on a red light source, scans all the pixels again, turns on a green light source, scans all the pixels finally, and turns on a blue light source so the scheme must perform three frames, one for each of red, green, and blue according to the spatial division color expression scheme. Therefore, a driving speed is increased, and a charging margin may become insufficient.

The above information disclosed in this Background section is only for enhancement of understanding of the background of the invention and therefore it may contain information that does not form the prior art that is already known in this country to a person of ordinary skill in the art.

SUMMARY

Exemplary embodiments of the present invention provide a display device for acquiring a margin for sufficiently charging a pixel and decreasing mixture of lights of different colors in adjacent frames, and a driving method thereof.

Additional features of the invention will be set forth in the description which follows, and in part will be apparent from the description, or may be learned by practice of the invention.

Exemplary embodiments of the present invention provide a display device including: a display panel configured with rows of pixels, each row pixels including a first color pixel, a second color pixel, and a third color pixel; and a backlight assembly configured to supply light to the display panel, in which: a data signal is alternately applied to a first color pixel disposed in an odd row on an odd frame, and to another first color pixel disposed in an even row on an even frame, a data signal is alternately applied to a second color pixel disposed in the odd row on the odd frame, and to another second color pixel disposed in the even row on the even frame, a data signal is applied to a third color pixel on the odd frame and the even frame, and colors of light supplied to the display panel on the odd frame and the even frame are different from each other.

Exemplary embodiments of the present invention provide a method for driving a display device having a display configured with rows of pixels and a backlight assembly for supplying light to the display panel, the method including: applying a data signal to a first color pixel, a second color pixel, and a third color pixel disposed in an odd row of the display panel on an odd frame; applying a data signal to a third color pixel disposed in an even row of the display panel on the odd frame; applying a data signal to the third color pixel disposed in the odd row of the display panel on an even frame; and applying a data signal to a first color pixel, a second color pixel, and the third color pixel disposed in the even row of the display panel on the even frame.

It is to be understood that both the foregoing general description and the following detailed description are exemplary and explanatory and are intended to provide further explanation of the invention as claimed. Other features and aspects will be apparent from the following detailed description, the drawings, and the claims.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
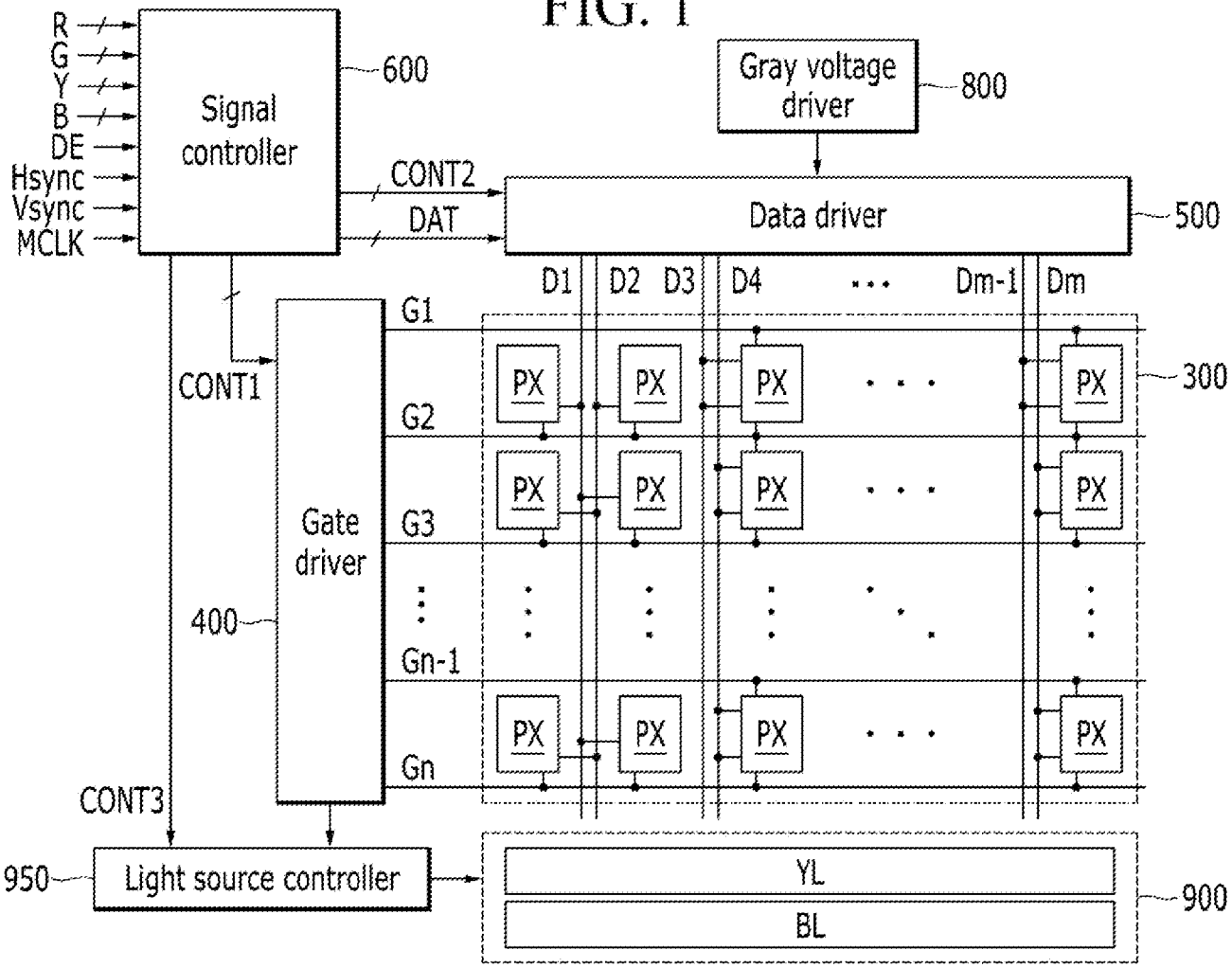
FIG. 1 shows a block diagram of a display device according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. It will be understood that for the purposes of this disclosure, "at least one of X, Y, and Z" can be construed as X only, Y only, Z only, or any combination of two or more items X, Y, and Z (e.g., XYZ, XZ, XYY, YZ, ZZ). Throughout the drawings and the detailed description, unless otherwise described, the same drawing reference numerals are understood to refer to the same elements, features, and structures. The relative size and depiction of these elements may be exaggerated for clarity.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

A display device according to exemplary embodiments of the present invention will now be described with reference to accompanying drawings.

Figure 2:
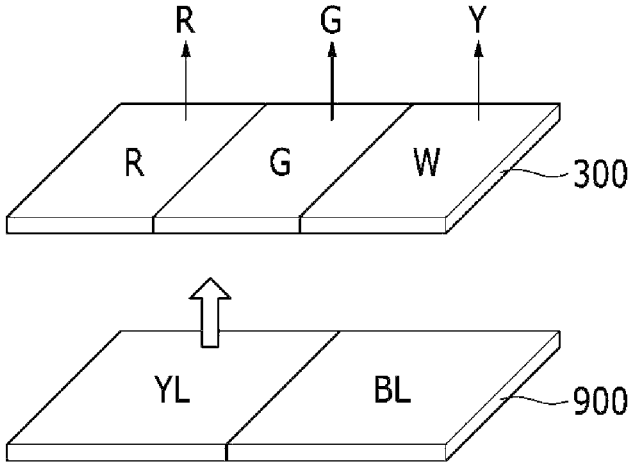
FIG. 2 and FIG. 3 show a part of a display device according to an exemplary embodiment of the present invention.
Figure 3:
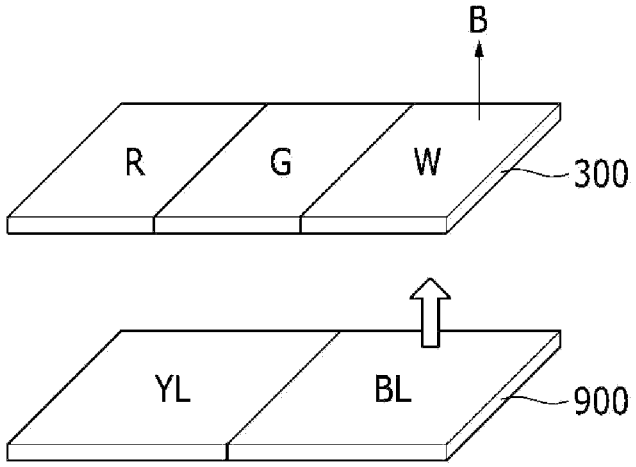

FIG. 1 shows a block diagram of a display device according to an exemplary embodiment of the present invention. FIG. 2 and FIG. 3 show a part of a display device according to an exemplary embodiment of the present invention.

As shown in FIG. 1, the display device includes a liquid crystal panel assembly 300, a gate driver 400 and a data driver 500 connected thereto, a gray voltage generator 800 connected to the data driver 500, a light source unit 900 to scan light to the liquid crystal panel assembly 300, a light source controller 950 to control the light source unit 900, and a signal controller 600.

The liquid crystal panel assembly 300 includes a plurality of signal lines (G1-Gn, D1-Dm) and a plurality of pixels (PX) connected thereto and substantially arranged in a matrix form.

The signal lines (G1-Gn, D1-Dm) include a plurality of gate lines (G1-Gn) to transmit a gate signal (also called a scanning signal) and a plurality of data lines (D1-Dm) to transmit a data signal. The gate lines (G1-Gn) are substantially extended in a row direction and substantially parallel with each other, and the data lines (D1-Dm) are substantially extended in a column direction and substantially parallel with each other.

One or more pixels (PX) are connected to one or more of the gate lines (G1-Gn) and the data lines (D1-Dm). For example, one pixel (PX) may be connected to one of gate lines (G1-Gn) and one of data lines (D1-Dm), and another pixel (PX) may be connected to two of the gate lines (G1-Gn) and two of the data lines (D1-Dm).

Although not shown, one or more of the pixels (PX) may be connected to the gate lines (G1-Gn) and the data lines (D1-Dm) through a switching element. Further, a voltage may be applied to the pixel (PX) by an on/off operation by the switching element. The switching element may be configured with a three-terminal element, such as a thin film transistor. A control terminal may be connected to the gate lines (G1-Gn). An input terminal may be connected to the data lines (D1-Dm).

The gray voltage generator 800 may generate two gray voltage sets (or reference gray voltage sets) relating to transmittance of the pixel (PX). One of the two gray voltage sets may have a positive value for the common voltage (Vcom) and the other gray voltage set may have a negative value for the same.

The gate driver 400 is connected to the gate lines (G1-Gn) of the liquid crystal panel assembly 300, and applies a gate signal, which may be a combination of a gate-on voltage (Von) and a gate-off voltage (Voff), to the gate lines (G1-Gn).

The data driver 500 is connected to the data lines (Da1-Dbm) of the liquid crystal panel assembly 300. The data driver 500 may select the gray voltage from the gray voltage generator 800, and may apply the same as a data signal to the data lines (Da1-Dbm).

The respective pixels (PX) may include color filters having different colors to realize color expression, as shown in FIG. 2 and FIG. 3. For example, the pixel includes a red pixel (R) including a red filter, a green pixel (G) including a green filter, and a white pixel (W) including a white filter or a transparent filter. However, the white pixel (W) need not include a white filter or any color filter. The red pixel (R) allows light with a red wavelength to pass through, and absorbs light of wavelengths other than the red wavelength. The green pixel (G) allows light with a green wavelength to pass through, and absorbs light of wavelengths other than the green wavelength. The white pixel (W) allows light of all wavelengths to pass through.

The light source unit 900 includes multiple light sources, which may be configured to emit light of different colors. The light sources include a yellow light source (YL) and a blue light source (BL). The light sources (YL, BL) may be formed with, for example, light emitting diodes (LED). The light source unit 900 may be disposed in a peripheral or a rear area of the liquid crystal panel assembly 300. The light source unit 900 may supply light to the liquid crystal panel assembly 300. The yellow light source (YL) may emit yellow light and supply the yellow light to the liquid crystal panel assembly 300. The blue light source (BL) may emit blue light and supply the blue light to the liquid crystal panel assembly 300.

The light source unit may alternately drive (e.g., via temporal division) the yellow light source (YL) and the blue light source (BL) with respect to time so that a desired color may be recognized with a temporal sum of the colors.

As shown in FIG. 2, the blue light source (BL) may not be driven while the yellow light source (YL) is driven. When the yellow light source (YL) is driven to emit yellow light and supply the same to the liquid crystal panel assembly 300, red light passes through the red pixel (R). In a like manner, green light passes through the green pixel (G), and yellow light passes through the white pixel (W). The yellow light may include red and green wavelengths.

As shown in FIG. 3, the yellow light source (YL) may not be driven while the blue light source (BL) is driven. When the blue light source (BL) is driven to emit blue light and supply the same to the liquid crystal panel assembly 300, no light or light below a reference amount may pass through the red pixel (R) and the green pixel (G). This is because the blue light rarely includes red and green wavelengths. The blue light may pass through the white pixel (W).

The yellow light source (YL) and the blue light source (BL) may be alternately driven for each frame of a video image or an image frame. For example, the yellow light source (YL) may be driven in an odd-numbered frame to allow red light, green light, and yellow light to pass through the liquid crystal panel assembly 300, and the blue light source (BL) may be driven in an even-numbered frame to allow blue light to pass through the liquid crystal panel assembly 300 to display a color screen according to their sum or combination.

The light source controller 950 may receive a light source control signal (CONT3) from the signal controller 600 and a synchronization signal from the gate driver 400. The light source controller 950 may output a control signal for turning on/off the light sources (YL, BL).

The signal controller 600 may control the gate driver 400, the data driver 500, and the light source controller 950.

One or more driving devices (e.g., gate driver 400, data driver 500, gray voltage driver 800, light source controller 950, and signal controller 600) may be mounted as an integrated circuit (IC) chip on at least one of the liquid crystal panel assembly 300. Further, one or more driving devices may be mounted on a flexible printed circuit film (not shown) and be attached as a tape carrier package (TCP) to the liquid crystal panel assembly 300. In addition, one or more driving devices may be mounted on an additional printed circuit board (PCB) (not shown). However, aspects of the invention are not limited thereto, such that one or more of the driving devices may be integrated on the liquid crystal panel assembly 300 together with the signal lines (G1-Gn, D1-Dm) and the switching element. Further, two or more of the driving devices may be integrated as a single chip. At least one of driving devices or at least one circuit element configuring them may be disposed outside the single chip.

Although the pixel (PX) is described as being configured with the red pixel (R), the green pixel (G), and the white pixel (W), and the light source unit 900 is described as including the yellow light source (YL) and the blue light source (BL), aspects of the invention are not limited thereto, such that the colors of the pixels (PX) and the light sources may be varied in many ways.

A display device according to an exemplary embodiment of the present invention will now be described with reference to FIG. 4.

Figure 4:
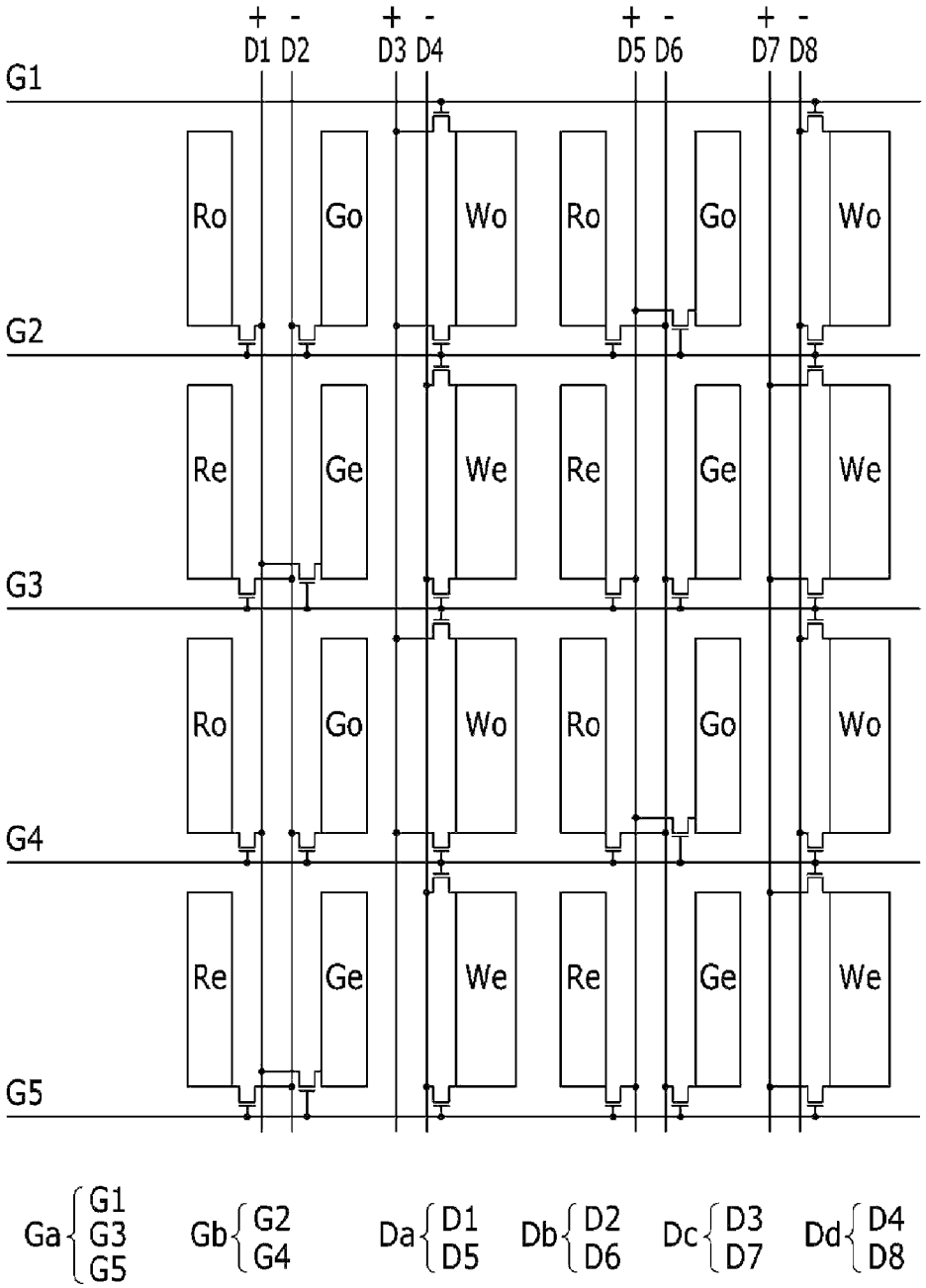
FIG. 4 shows a plurality of pixels, gate lines, and data lines of a display device according to an exemplary embodiment of the present invention.

FIG. 4 shows a plurality of pixels, gate lines, and data lines of a display device according to an exemplary embodiment of the present invention.

A plurality of pixels (PX) of a display device may be disposed or arranged in a matrix configuration. More specifically, a plurality of pixels (PX) may be disposed in a column direction and in a row direction. As described above, a plurality of pixels (PX) may include a red pixel (R), a green pixel (G), and a white pixel (W). The red pixel (R), the green pixel (G), and the white pixel (W) may be alternately arranged in the row direction. Further, the pixels (PX) with the same color may be disposed in the column direction. For example, the red pixel (R) may be disposed on the first column, the green pixel (G) may be disposed on the second column, and the white pixel (W) may be disposed on the third column. In addition, the red pixel (R) may be disposed on the fourth column, the green pixel (G) may be disposed on the fifth column, and the white pixel (W) may be disposed on the sixth column.

First set of gate lines (Ga) and second set of gate lines (Gb) are connected to the pixels (PX). The first set of gate lines or first gate line set (Ga) includes gate lines G1, G3, and G5. The second set of gate lines or second gate line set (Gb) includes gate lines G2 and G4. A plurality of gate lines (G1, G2, G3, G4, and G5) are extended in parallel with each other. The gate lines may be disposed in the row direction between the neighboring pixels (PX). The gate lines included in the first set of gate lines (Ga) and the gate lines included in the second set of gate lines (Gb) are alternately arranged. For example, the gate lines included in the first set of gate lines (Ga) may be configured with the gate lines G2 and G4 that are disposed at a lower side, and the gate lines included in the second set of gate lines (Gb) may be configured with the gate lines G1, G3, and G5 that are disposed at an upper side, with respect to the pixels (PX) disposed in the odd rows in the ground plan.

The red pixel (R) disposed in the odd rows and the green pixel (G) disposed in the odd rows may be connected to gate lines of the first gate line set (Ga). The red pixel (R) disposed in the even rows and green pixel (G) disposed in the even rows are connected to gate lines of the second gate line set (Gb). The white pixel (W) is connected to both the first set of gate lines (Ga) and the second set of gate lines (Gb).

Data lines of data line sets including a first data line set (Da), a second data line set (Db), a third data line set (Dc), and a fourth data line set (Dd), are connected to the respective pixels (PX). The first data line set (Da) includes a first data line (D1) and a fifth data line (D5). The second data line set (Db) includes a second data line (D2) and a sixth data line (D6). The third data line set (Dc) includes a third data line (D3) and a seventh data line (D7). The fourth data line set (Dd) includes a fourth data line (D4) and an eighth data line (D8). Data lines included in the data line sets (Da, Db, Dc, Dd) are extended in parallel with each other, and may be disposed in the column direction between the neighboring pixels (PX). A plurality of data lines included in the data line sets (Da, Db, Dc, Dd) may be disposed between the two neighboring pixels (PX). Each data line set of the first data line set (Da), the second data line set (Db), the third data line set (Dc), and the fourth data line set (Dd), are disposed between two pixels (PX). For example, data lines of the first data line set (Da) and data lines of the second data line set (Db) are disposed between the red pixel (R) and the green pixel (G). Further, data lines of the third data line set (Dc) and data lines of the fourth data line set (Dd) are disposed between the green pixel (G) and the white pixel (W). Data lines included the data line sets (Da, Db, Dc, Dd), such as data lines D1, D2, D3, and D4, are disposed between the red pixel (R) and the white pixel (W). Data lines of the first data line set (Da), the second data line set (Db), the third data line set (Dc), and the fourth data line set (Dd) are disposed in order (e.g., D1, D2, D3, D4). Data lines of the respective data line sets may continue in this order starting again from a data line of the first data line set (Da) (e.g., D5, D6, D7, and D8).

The red pixel (R) is connected to a data line of the first data line set (Da) or the second data line (Db) set. The green pixel (G) is connected to a data line of the first data line set (Da) or the second data line set (Db). The white pixel (W) is connected to a data line of the third data line set (Dc) or the fourth data line set (Dd). The pixels (PX) adjacent in the row direction or the column direction are connected to the different data line sets (Da, Db, Dc, Dd). For example, when the red pixel (R) and the green pixel (G), which is adjacent to the red pixel (R) in the row direction, the red pixel (R) is connected to one or more of the data lines included in the first data line set (Da), and the green pixel (G) is connected to one or more of the data lines included in the second data line set (Db). Also, when the red pixel (R) is arranged to be adjacent to another red pixel (R) in the column direction, one of the two neighboring red pixels (R) is connected to a data of the first data line set (Da), and the other red pixel (R) is connected to a data line of the second data line set (Db).

The red pixels (Ro, Re) disposed in the same row may be alternately connected to the data lines of the first data line set (Da) and the second data line (Db). The red pixels (Ro, Re) disposed in the same column may be alternately connected to the data lines of the first data line (Da) and second data line (Db). For example, the first red pixel (Ro) disposed in the odd row may be connected to a data line in the first data line set (Da), and the second red pixel (Re) disposed in the odd row may be connected to a data line in the second data line set (Db). The first red pixel (Ro) disposed in the even row may be connected to a data line in the second data line set (Db), and the second red pixel (Re) disposed in the even row may be connected to a data line in the first data line set (Da). Although an exemplary configuration is illustrated in FIG. 4, aspects of the invention are not limited thereto, such that a first red pixel (Ro) disposed in the odd row may be connected to a data line included in the second data line set (Db), and a second red pixel (Re) disposed in the odd row may be connected to a data line included in the first data line set (Da). Further, the first red pixel (Ro) disposed in the even row may be connected to a data line included in the first data line set (Da), and the second red pixel (Re) disposed in the even row may be connected to a data line included in the second data line set (Db).

Referring to FIG. 4, pixels disposed between the first gate line (G1) and the second gate line (G2) may be referred to as a first row. Pixels disposed between the second gate line (G2) and the third gate line (G3) may be referred to as a second row. Pixels disposed between the third gate line (G3) and the fourth gate line (G4) may be referred to as a third row. Pixels disposed between the fourth gate line (G4) and the fifth gate line (G5) may be referred to as a fourth row. Odd rows may include the first row and the third row. Even rows may include the second row and the fourth row.

The green pixels (Go, Ge) disposed in the same row may be alternately connected to the data lines included in the first data line set (Da) and the second data line set (Db). The green pixels (Go, Ge) disposed in the same column may be alternately connected to the data lines included in the first data line set (Da) and second data line set (Db). For example, a first green pixel (Go) disposed in the odd row may be connected to a data line included in the second data line set (Db), and a second green pixel (Ge) disposed in the odd row may be connected to a data line included in the first data line set (Da). The first green pixel (Go) disposed in the even row may be connected to a line included in the first data line set (Da), and the second green pixel (Ge) disposed in the even row may be connected to a data line included in the second data line set (Db). Although an exemplary configuration is illustrated in FIG. 4, aspects of the invention are not limited thereto, such that the first green pixel (Go) disposed in the odd row may be connected to a data line included in the first data line set (Da), and the second green pixel (Ge) disposed in the odd row may be connected to a data line included in the second data line set (Db). Further, the first green pixel (Go) disposed in the even row may be connected to a data line included in the second data line set (Db), and the second green pixel (Ge) disposed in the even row may be connected to a data line included in the first data line set (Da).

The white pixels (Wo, We) disposed in the same row may be alternately connected to the data lines included in the third data line set (Dc) and the fourth data line set (Dd). The white pixels (Wo, We) disposed in the same column may be alternately connected to the data lines included in the third data line set (Dc) and the fourth data line set (Dd). For example, the first white pixel (Wo) disposed in the odd row may be connected to a data line included in the third data line set (Dc), and the second white pixel (We) disposed in the odd row may be connected to a data line included in the fourth data line set (Dd). The first white pixel (Wo) disposed in the even row may be connected to a data line included in the fourth data line set (Dd), and the second white pixel (We) disposed in the even row may be connected to a data line included in the third data line set (Dc). Although an exemplary configuration is illustrated in FIG. 4, aspects of the invention are not limited thereto, such that the first white pixel (Wo) disposed in the odd row may be connected to a data line of the fourth data line set (Dd), and the second white pixel (We) disposed in the odd row may be connected to a data line of the third data line set (Dc). Further, the first white pixel (Wo) disposed in the even row may be connected to a data line of the third data line set (Dc), and the second white pixel (We) disposed in the even row may be connected to a data line of the fourth data line set (Dd).

A polarity of the data signal applied to a data line of the first data line set (Da) and the third data line set (Dc) may be different from a polarity of the data signal applied to a data line of the second data line set (Db) and the fourth data line set (Dd). The data signal with the same polarity (e.g., positive) may be applied to a data line of the first data line set (Da) and the third data line set (Dc), and the data signal with the same polarity (e.g., negative), which may be different from the polarity applied to the data line of the first data line set (Da) and the third data line set (Dc), may be applied to a data line of the second data line set (Db) and the fourth data line set (Dd). The polarity of the data signal may be configured as positive and negative. The voltage with a positive data signal may be set to be greater than a predetermined voltage, and the voltage with a negative data signal may be set to be less than a predetermined voltage.

For example, the positive data signal may be applied to a data line of the first data line set (Da) and the third data line set (Dc), and the negative data signal may be applied to a data line of the second data line set (Db) and the fourth data line set (Dd). Further, the polarities of the pixels (PX) arranged adjacently in the row direction may be different, and the polarities of the pixels (PX) arranged adjacently in the column direction may be different. For example, if the polarity of the first red pixel (Ro) in the first row is positive, the polarity of the first green pixel (Go) in the first row and the first red pixel (Ro) in the second row is negative. The polarity of the data signal applied to the data lines included in the data line sets Da, Db, Dc, and Dd may be changed with one or two frames as a period.

One or more pixels (PX) may be connected to gate lines of the gate line sets (Ga, Gb) and data lines of the data line sets (Da, Db, Dc, Dd) through the switching element (S). The switching element (S) may be a three-terminal element and may be configured with a thin film transistor. The switching element (S) may include at least one of a control terminal, an input terminal, and an output terminal. The control may be connected to gate lines of the gate line sets (Ga, Gb). The input terminal may be connected to data lines of the data line sets (Da, Db, Dc, Dd). The output terminal may be connected to the pixel (PX).

One pixel (PX) may be connected to one or at least two switching elements (S). The red pixel (R) may be connected to one gate line of the gate line sets (Ga, Gb) and one data line of the data line sets (Da, Db, Dc, Dd) through one switching element (S). The green pixel (G) may be connected to one gate line of the gate line sets (Ga, Gb) and one data line of the data line sets (Da, Db, Dc, Dd) through one switching element (S). The white pixel (W) may be connected to two gate lines of the gate line sets (Ga, Gb) and one data line of the data line sets (Da, Db, Dc, Dd) through two switching elements (S).

The white pixel (W) may be connected to the two gate lines of the gate line sets (Ga, Gb) to receive the data signal when the gate-on voltage is applied to the first gate line (Ga). Further, the white pixel may also receive the data signal when the gate-on voltage is applied to the second gate line (Gb).

The white pixel (W) may be formed to be larger than at least one of the red pixel (R) and the green pixel (G) to improve an aperture ratio.

A method for driving a display device according to an exemplary embodiment of the present invention will now be described with reference to FIG. 5 and FIG. 6.

Figure 5:
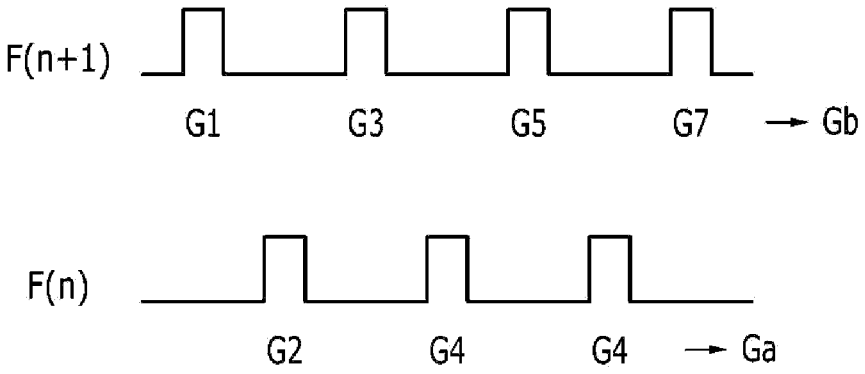
FIG. 5 shows a waveform diagram of a gate signal applied to a display device according to an exemplary embodiment of the present invention.

FIG. 5 shows a waveform diagram of a gate signal applied to a display device according to an exemplary embodiment of the present invention. FIG. 6 shows a schematic view of a data signal applied to a display device for each frame according to an exemplary embodiment of the present invention. FIG. 6 shows three pixels disposed in the odd row or odd line PX and three pixels disposed in the even row or even line PX. The three pixels illustrated or described with respect to FIG. 5 and FIG. 6 include a red pixel, a green pixel, and a white pixel. However, aspects of the invention are not limited thereto, such that pixels may include different color pixels.

As shown in FIG. 5, gate lines of the first gate line (Ga) and the second gate line (Gb) may alternately drive for each unit of two frames.

In the n-th frame (F(n)), a gate-on voltage may be applied to a gate line of the first gate line set (Ga), and a gate-off voltage may be applied to a gate line of the second gate line set (Gb). In the (n+1)th frame (F(n+1)), the gate-off voltage may be applied to a gate line of the first gate line set (Ga), and the gate-on voltage may be applied to a gate line of the second gate line set (Gb). Further, the n-th frame (F(n)) may be an odd-numbered frame, and the (n+1)th frame (F(n+1)) may be an even-numbered frame. Therefore, a gate line of the first gate line set (Ga) may be driven in the odd frame, and a gate line of the second gate line set (Gb) may be driven in the even frame. However, aspects of the invention are not limited thereto, such that a gate line of the first gate line set (Ga) may be driven in the even frame and a gate line of the second gate line set (Gb) may be driven in the odd frame.

Figure 6:
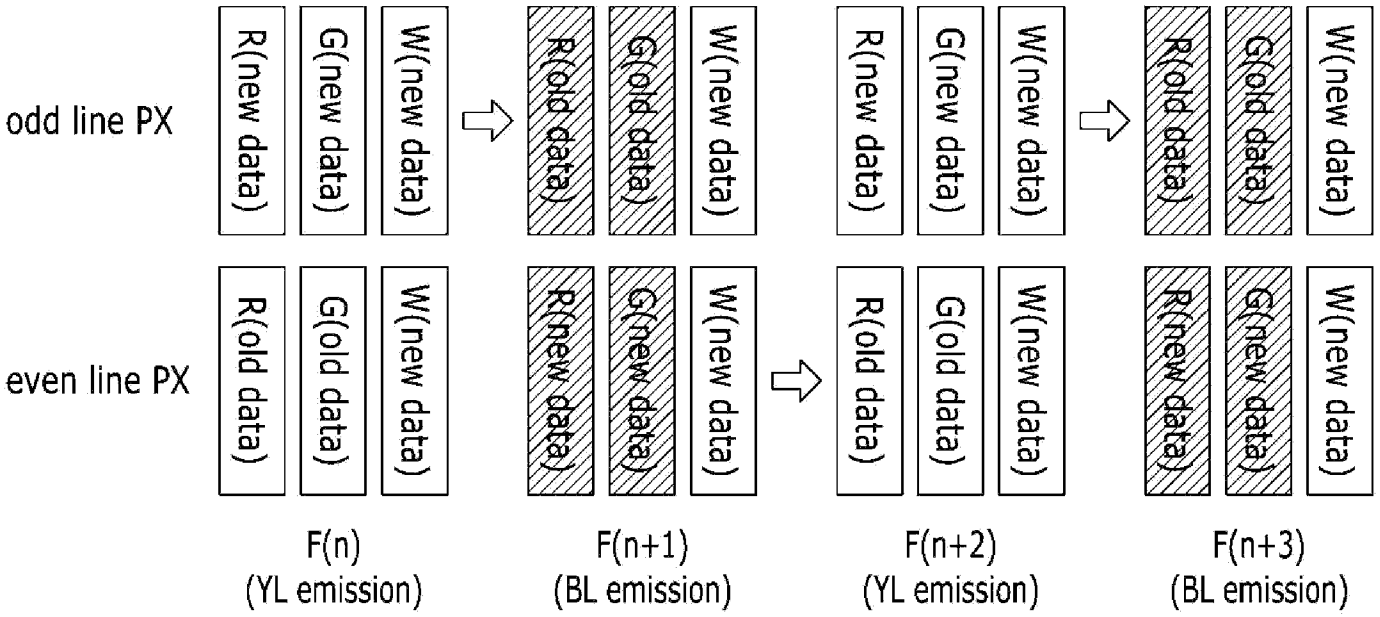
FIG. 6 shows a schematic view of a data signal applied to a display device for each frame according to an exemplary embodiment of the present invention.

As shown in FIG. 6, a data signal is applied to the red pixel (R) and the green pixel (G) for two of the four frames, and a data signal is applied to the white pixel (W) for each of the four frames.

In the n-th frame (F(n)), a new data signal (new data) may be applied to the red pixel (R) and the green pixel (G) disposed in the odd row, and a data signal (old data) applied in the previous frame may be maintained at the red pixel (R) and the green pixel (G) disposed in the even row. In the n-th frame (F(n)), a new data signal (new data) is applied to the white pixel (W) disposed in the odd row and the white pixel (W) disposed in the even row. In the n-th frame (F(n)), the yellow light source (YL) may be driven to supply yellow light. Therefore, the red pixel (R) and the green pixel (G) may pass red light and green light through, and the white pixel (W) may pass yellow light through.

In the (n+1)th frame (F(n+1)), a data signal (old data) applied in the previous frame, the n-th frame (F(n)), may be maintained at the red pixel (R) and green pixel (G) disposed in the odd row, and a new data signal (new data) may be applied to the red pixel (R) and green pixel (G) disposed in the even row. In the (n+1)th frame (F(n+1)), a new data signal (new data) may be applied to the white pixel (W) disposed in the odd row and the white pixel (W) disposed in the even row. In the (n+1)th frame (F(n+1)), the blue light source (BL) may be driven to supply blue light, which may lack the red wavelength and the green wavelength. Therefore, the red pixel (R) and the green pixel (G) may block passage of the light wavelengths included in the blue light and may show a black state, and the white pixel (W) may pass blue light through.

In the (n+2)th frame (F(n+2)), a new data signal (new data) may be applied to the red pixel (R) and green pixel (G) disposed in the odd row, and a data signal (old data) applied in the previous frame, the (n+1)th frame (F(n+1)), may be maintained at the red pixel (R) and green pixel (G) disposed in the even row. In the (n+2)th frame (F(n+2)), a new data signal (new data) may be applied to the white pixel (W) disposed in the odd row and the white pixel (W) disposed in the even row. In the (n+2)th frame (F(n+2)), the yellow light source (YL) may be driven to supply yellow light, which may include the red wavelength and the green wavelength. Therefore, the red pixel (R) and the green pixel (G) may pass red light and green light through, and the white pixel (W) may pass yellow light through.

In the (n+3)th frame (F(n+3)), a data signal (old data) applied in the previous frame, more specifically, the (n+2)th frame (F(n+2)), may be maintained at the red pixel (R) and the green pixel (G) disposed in the odd row, and a new data signal (new data) may be applied to the red pixel (R) and the green pixel (G) disposed in the even row. In the (n+3)th frame (F(n+3)), a new data signal (new data) may be applied to the white pixel (W) disposed in the odd row and white pixel (W) disposed in the even row. In the (n+3)th frame (F(n+3)), the blue light source (BL) may be driven to supply blue light. Therefore, the red pixel (R) and the green pixel (G) may display black light or no light passing therethrough, and the white pixel (W) may pass blue light through.

In an example, the n-th frame (F(n)) and the (n+2)th frame (F(n+2)) may be odd frames, and the (n+1)th frame (F(n+1)) and the (n+3)th frame (F(n+3)) may be even frames.

The data signal may be applied to the red pixel (R) disposed in the odd row in the odd frame, and the data signal may be applied to the red pixel (R) disposed in the even row in the even frame. However, aspects of the invention are not limited thereto, such that it may be possible for the data signal to be applied to the red pixel (R) disposed in the odd row in the even frame and the data signal to be applied to the red pixel (R) disposed in the even row in the odd frame. More specifically, the data signal may be alternately applied to the red pixel (R) disposed in the odd row and the red pixel (R) disposed in the even row in the odd frame and/or the even frame. The red pixel (R) may be connected to one gate line of the gate line sets (Ga, Gb), which may be alternately driven.

The data signal may be applied to the green pixel (G) disposed in the odd row in the odd frame, and the data signal may be applied to the green pixel (G) disposed in the even row in the even frame. However, aspects of the invention are not limited thereto, such that it may be possible for the data signal to be applied to the green pixel (G) disposed in the odd row in the even frame and the data signal to be applied to the green pixel (G) disposed in the even row in the odd frame. More specifically, the data signal may be alternately applied to the green pixel (G) disposed in the odd row and the green pixel (G) disposed in the even row in the odd frame and the even frame. The green pixel (G) may be connected to one gate line of the gate line sets (Ga, Gb), which may be alternately driven.

The data signal may be applied to the white pixel (W) in the odd frame and the even frame. The white pixel (W) may be connected to a gate line of the gate line sets (Ga, Gb) to receive a new data signal for each frame when the gate lines of the gate line sets (Ga, Gb) are alternately driven.

Although it has been described above that the yellow light source (YL) is driven in the odd frame and the blue light source (BL) is driven in the even frame, aspects of the invention are not limited thereto, such that the yellow light source (YL) may be driven in the even frame, and the blue light source (BL) may be driven in the odd frame.

A characteristic for preventing or limiting mixture of light with different colors in a display device according to an exemplary embodiment of the present invention will now be described with reference to FIG. 7 and FIG. 8.

Figure 7:
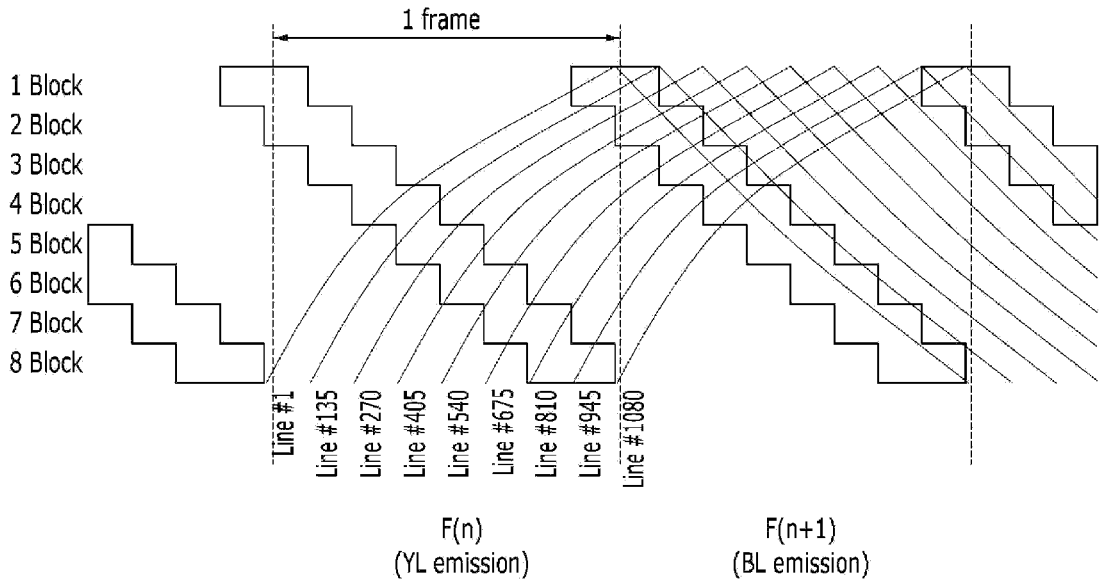
FIG. 7 shows a graph for timing when a pixel is charged and timing when a light source is driven for each block in a general display device.

FIG. 7 shows a graph for timing when a pixel is charged and timing when a light source is driven for each block in a general display device. FIG. 8 shows a graph for timing when a pixel is charged and timing when a light source is driven for each block in a display device according to an exemplary embodiment of the present invention.

Figure 8:
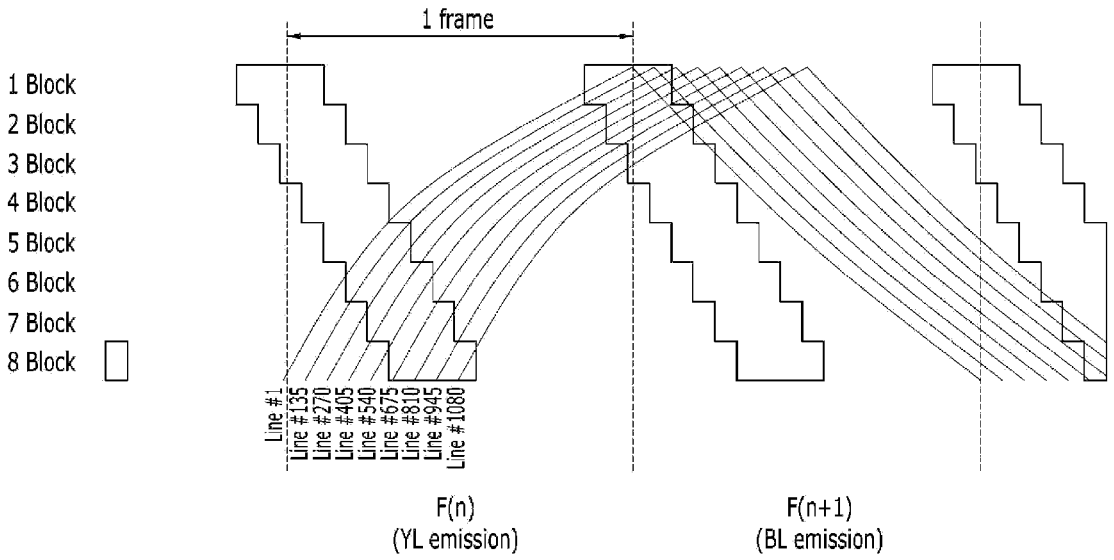
FIG. 8 shows a graph for timing when a pixel is charged and timing when a light source is driven for each block in a display device according to an exemplary embodiment of the present invention.

Parts that are shown with lines in FIG. 7 and FIG. 8 indicate times at which the pixels connected to the gate lines are charged. The pixels may be charged sequentially in order of the gate lines in the n-th frame (F(n)). More specifically, the pixel connected to the gate line with the number 1 (Line #1) is charged, and the pixels connected to the gate line 135 (Line #135), gate line 270 (Line #270), gate line 405 (Line #405), gate line 540 (Line #540), gate line 675 (Line #675), gate line 810 (Line #810), gate line 945 (Line #945), and gate line 1080 (Line #1080) may then sequentially charged. The timing for charging the pixels connected to designated gate lines from among the entire gate lines is shown.

In a general display device, the gate-on voltage may be applied to all of the gate lines for each frame to charge all of the pixels. Therefore, as shown in FIG. 7, a time for charging all of the pixels may be relatively long.

However, in the display device according to an exemplary embodiment of the present invention, the gate lines may be divided into a first gate line set and a second gate line set and driven by an odd frame and an even frame, respectively. Therefore, the gate-on voltage may be applied to half or less than all of the gate lines. Accordingly, as shown in FIG. 8, the time for charging the pixel may be reduced.

Blocks illustrated in FIG. 7 and FIG. 8 indicate timing at which a light source unit is driven. The light source unit may be divided into a plurality of blocks and then be driven. The plurality of blocks may be divided in a direction in parallel with the gate line. For example, the first block corresponds to a portion of the light source unit that corresponds to a region between gate line 1 (Line #1) and gate line 135 (Line #135), the second block corresponds to a portion of the light source unit that corresponds to a region between gate line 135 (Line #135) and gate line 270 (Line #270), and the third block corresponds to a portion of the light source unit that corresponds to a region between gate line 270 (Line #270) and gate line 405 (Line #405). The fourth block corresponds to a portion of the light source unit that corresponds to a region between gate line 405 (Line #405) and gate line 540 (Line #540), the fifth block corresponds to a portion of the light source unit that corresponds to a region between gate line 540 (Line #540) and gate line 675 (Line #675), and the sixth block corresponds to a portion of the light source unit that corresponds to a region between gate line 675 (Line #675) and gate line 810 (Line #810). The seventh block corresponds to a portion of the light source unit that corresponds to a region between gate line 810 (Line #810) and gate line 945 (Line #945), and the eighth block corresponds to a portion of the light source unit that corresponds to a region between gate line 945 (Line #945) and gate line 1080 (Line #1080).

The blocks of the light source unit may be sequentially driven in order of the first block, the second block, the third block, the fourth block, the fifth block, the sixth block, the seventh block, and the eighth block. The first block may be driven when the gate-on voltage is applied to gate line 1 (Line #1) to gate line 135 (Line #135), and the second block may be driven when the gate-on voltage is applied to gate line 136 (Line #136) to gate line 270 (Line #270).

The yellow light source (YL) may be sequentially driven for the respective blocks in the n-th frame (F(n)), and the blue light source (BL) may be sequentially driven for the respective blocks in the (n+1)th frame (F(n+1)).

In the general display device, the gate-on voltage is applied to all gate lines so the time for driving the light source unit from the first block to the last block may be relatively long. Therefore, a time frame at which the yellow light source (YL) is provided in the last block in the n-th frame (F(n)) may overlap a time frame at which the blue light source (BL) is provided in the first block in the (n+1)th frame (F(n+1)). Accordingly, light with different colors may be mixed.

In contrast, in the display device according to an exemplary embodiment of the present invention, the gate-on voltage may be applied to half of the gate lines so the time for driving the light source unit from the first block to the last block may be reduced. Therefore, the blue light source (BL) provided to the first block may start its driving in the (n+1)th frame (F(n+1)) when the driving of the yellow light source (YL) provided to the last block is finished in the n-th frame (F(n)). More specifically, the timing for driving the yellow light source (YL) provided to the last block in the n-th frame (F(n)) may not overlap the timing for driving the blue light source (BL) provided to the first block in the (n+1)th frame (F(n+1)). Accordingly, the mixture of different colors may be limited or prevented.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device comprising:

a display panel configured with rows of pixels, each row of pixels comprising a first color pixel, a second color pixel, and a third color pixel; and a backlight assembly configured to supply light to the display panel, wherein:

a data signal is alternately applied to a first color pixel disposed in an odd row on an odd frame, and to another first color pixel disposed in an even row on an even frame, a data signal is alternately applied to a second color pixel disposed in the odd row on the odd frame, and to another second color pixel disposed in the even row on the even frame, a data signal is applied to a third color pixel on the odd frame and the even frame, and colors of light supplied to the display panel on the odd frame and the even frame are different from each other.

2. The display device of claim 1, wherein the first color pixel is a red pixel, the second color pixel is a green pixel, and the third color pixel is a white pixel.

3. The display device of claim 2, wherein:

the backlight assembly comprises a yellow light emitting diode (LED) and a blue LED, and the yellow LED and the blue LED respectively emit light in the odd frame and the even frame.

4. The display device of claim 1, wherein:

the display panel further comprises a first gate line and a second gate line, the first color pixel and the second color pixel of the odd row are connected to the first gate line, the first color pixel and the second color pixel of the even row are connected to the second gate line, and the third color pixel is connected to the first gate line and the second gate line.

5. The display device of claim 4, wherein the first gate line and the second gate line are respectively driven in the odd frame and the even frame.

6. The display device of claim 5, wherein:

the display panel further comprises a first data line, a second data line, a third data line, and a fourth data line, the first color pixel is connected to the first data line or the second data line, the second color pixel is connected to the first data line or the second data line, and the third color pixel is connected to the third data line or the fourth data line.

7. The display device of claim 6, wherein:

the color pixels disposed adjacently in a row direction are connected to different data lines, and the colors pixels disposed adjacently in a column direction are connected to different data lines.

8. The display device of claim 7, wherein:

the first data line and the second data line are disposed in the column direction between the first color pixel and the second color pixel, and the third data line and the fourth data line are disposed in the column direction between the third color pixel and a fourth color pixel.

9. The display device of claim 7, wherein a polarity of a data signal applied to the first data line and the third data line is different from a polarity of a data signal applied to the second data line and the fourth data line.

10. The display device of claim 7, wherein the first color pixel is a red pixel, the second color pixel is a green pixel, and the third color pixel is a white pixel.

11. The display device of claim 10, wherein:

the backlight assembly comprises a yellow LED and a blue LED, and the yellow LED and the blue LED respectively emit light in the odd frame and the even frame.

12. A method for driving a display device having a display panel configured with rows of pixels and a backlight assembly for supplying light to the display panel, the method comprising:

applying a data signal to a first color pixel, a second color pixel, and a third color pixel disposed in an odd row of the display panel on an odd frame;

applying a data signal to a third color pixel disposed in an even row of the display panel on the odd frame;

applying a data signal to the third color pixel disposed in the odd row of the display panel on an even frame; and applying a data signal to a first color pixel, a second color pixel, and the third color pixel disposed in the even row of the display panel on the even frame.

13. The method of claim 12, wherein:

the applying of a data signal to the first color pixel, the second color pixel, and the third color pixel of the odd row and the third color pixel of the even row comprises supplying a first color light to the display panel, and the applying of a data signal to the third color pixel of the odd row and the first color pixel, the second color pixel, and the third color pixel of the even row comprises supplying a second color light to the display panel.

14. The method of claim 13, wherein:

the supplying of first color light comprises allowing the first color light to pass through the first color pixel, the second color pixel, and the third color pixel, and the supplying of second color light comprises allowing the second color light to pass through the third color pixel.

15. The method of claim 14, wherein when supplying the second color light, the first color pixel and the second color pixel display a black color.

16. The method of claim 15, wherein the first color pixel is a red pixel, the second color pixel is a green pixel, and the third color pixel is a white pixel.

17. The method of claim 16, wherein the first color light is a yellow light, and the second color light is a blue light.

18. The method of claim 13, wherein:

when the first color light is supplied, the second color light is not supplied to the display panel, and when the second color light is supplied, the first color light is not supplied to the display panel.

19. The method of claim 13, wherein the supplying of the first color light comprises allowing the first color pixel and the second color pixel of the even row to maintain the data signal applied in a previous frame.

20. The method of claim 19, wherein the supplying of the second color light comprises allowing the first color pixel and the second color pixel of the odd row to maintain the data signal applied in the previous frame.

* * * * *